US012201145B2

(12) United States Patent
Latuszek et al.

(10) Patent No.: US 12,201,145 B2
(45) Date of Patent: Jan. 21, 2025

(54) SMOKING ARTICLES STORAGE BOX

(71) Applicant: JT International S.A., Geneva (CH)

(72) Inventors: Dominik Latuszek, Trier (DE); Gabriela Greco Da Fonseca De Carvalho, Chêne-Bourg (CH); Jamie Buckley, Ditton (GB)

(73) Assignee: JT International S.A. (CH)

( * ) Notice: Subject to any disclaimer, the term of this patent is extended or adjusted under 35 U.S.C. 154(b) by 99 days.

(21) Appl. No.: 17/438,030

(22) PCT Filed: Apr. 1, 2019

(86) PCT No.: PCT/EP2019/058196
§ 371 (c)(1),
(2) Date: Sep. 10, 2021

(87) PCT Pub. No.: WO2020/200417
PCT Pub. Date: Oct. 8, 2020

(65) Prior Publication Data
US 2022/0142243 A1 May 12, 2022

(51) Int. Cl.
*A24F 15/01* (2020.01)
*B65D 5/50* (2006.01)
(Continued)

(52) U.S. Cl.
CPC ..... *A24F 15/01* (2020.01); *B65D 5/503* (2013.01); *B65D 5/68* (2013.01); *B65D 81/025* (2013.01); *B65D 85/10* (2013.01)

(58) Field of Classification Search
CPC ..... A24F 15/01; A24F 15/00; A24F 15/005; A61M 2209/06; B65D 85/10;
(Continued)

(56) References Cited

U.S. PATENT DOCUMENTS 3,692,264 A * 9/1972 Burkhard ..... G04B 43/002 206/583
4,027,794 A * 6/1977 Olson ..... B65D 5/5095 206/583
(Continued)

FOREIGN PATENT DOCUMENTS

CN 105980256 A 9/2016
CN 107082172 A 8/2017
(Continued)

OTHER PUBLICATIONS

International Search Report for Application No. PCT/EP2019/058196 mailed Jul. 8, 2019, pp. 1-3.
(Continued)

*Primary Examiner* — Steven A. Reynolds
*Assistant Examiner* — Prince Pal
(74) *Attorney, Agent, or Firm* — Lerner David LLP

(57) ABSTRACT

A smoking articles storage box includes an outer container having a base portion and a lid portion; a first storage layer element, arranged within the base portion at a lower level; and at least one higher-level element removably arranged within the base portion at a higher level; wherein the first storage layer element includes a first contact edge at one side and a second contact edge at the opposite side thereof, and wherein the first and second contact edges form support elements for the at least one higher-level element within the storage box 1.

15 Claims, 10 Drawing Sheets

Figure 1:
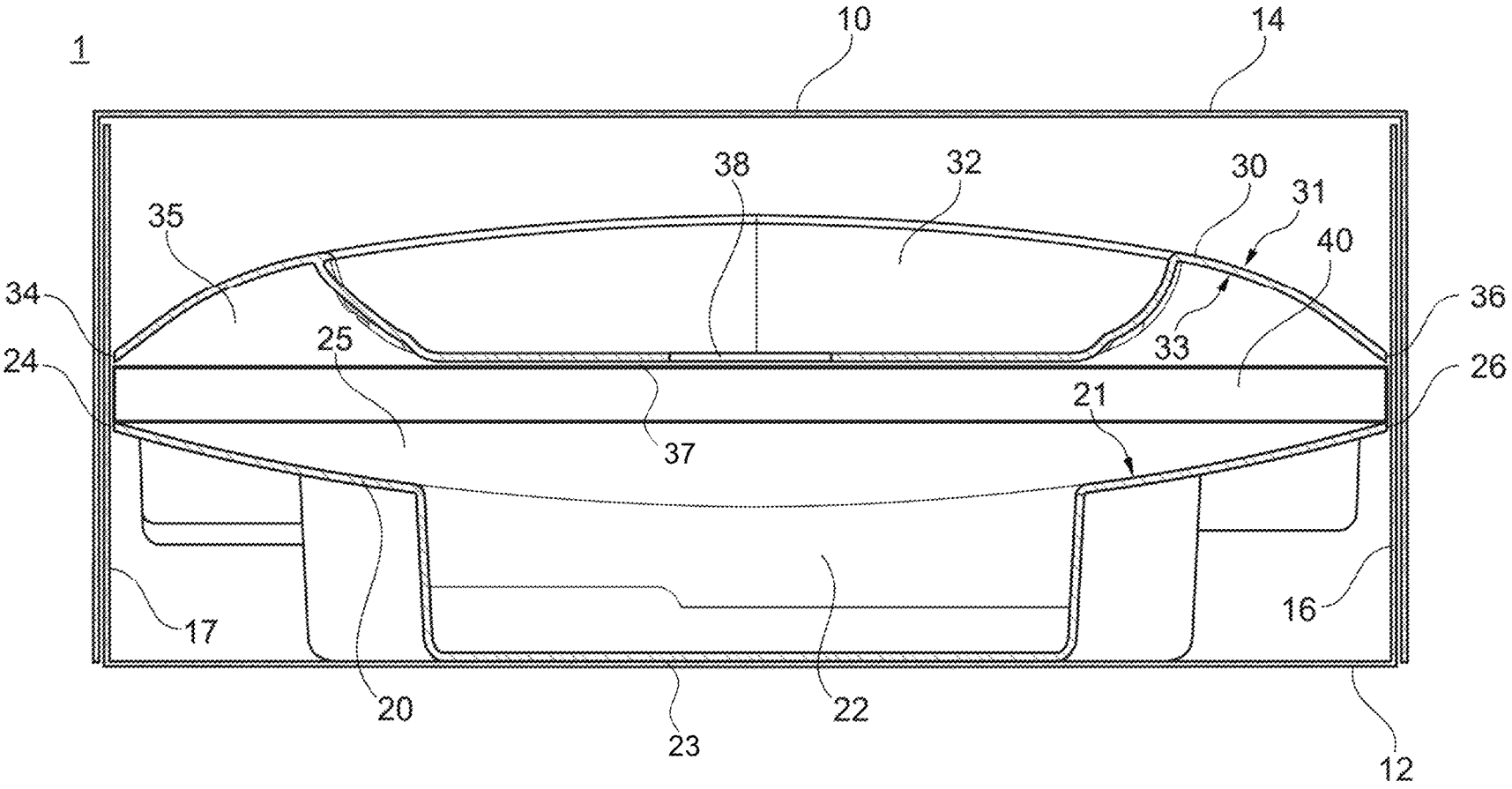

(51) Int. Cl.
*B65D 5/68* (2006.01)
*B65D 81/02* (2006.01)
*B65D 85/10* (2006.01)

(58) Field of Classification Search
CPC ..... B65D 85/1009; B65D 85/1018; B65D 85/1027; B65D 85/1036; B65D 85/1045; B65D 85/1048; B65D 85/10484; B65D 85/1054; B65D 85/1056; B65D 85/1063; B65D 85/1072; B65D 85/12; B65D 85/14
USPC ..... 206/307, 242, 4.24, 583, 806, 223, 521, 206/592, 564, 588, 485, 585; 220/4.21, 220/4.26, 4.27; 131/329
See application file for complete search history.

(56) References Cited

U.S. PATENT DOCUMENTS 6,105,765 A * 8/2000 Chu ..... B65D 81/025 206/592
6,268,039 B1 * 7/2001 Chou ..... B65D 5/5069 206/583
6,298,989 B1 10/2001 Chu
6,431,362 B1 * 8/2002 Araki ..... G03G 15/0896 206/588
7,328,800 B2 * 2/2008 Koike ..... B65D 5/58 206/592
7,419,055 B2 * 9/2008 Manuel ..... B65D 81/113 206/521
7,992,715 B2 * 8/2011 Kwon ..... G03G 15/0855 206/320
8,215,484 B2 * 7/2012 Lim ..... B65D 81/058 206/592
8,317,018 B2 * 11/2012 Florentz ..... B65D 85/12 206/242
10,403,527 B2 * 9/2019 Nagashima ..... H01L 21/67386
2004/0094448 A1 * 5/2004 Koike ..... B65D 77/042 206/521
2007/0187268 A1 * 8/2007 Djulaini ..... B65D 85/38 206/307
2007/0215509 A1 * 9/2007 Moses ..... G11B 23/0236 206/485
2009/0041969 A1 * 2/2009 Tanaka ..... B65D 5/5069 428/36.92
2012/0043249 A1 * 2/2012 Tsukii ..... B65D 81/05 206/521
2014/0124395 A1 5/2014 Nadeau
2015/0008147 A1 1/2015 Huang et al.
2015/0320113 A1 11/2015 Stebbins et al.
2018/0029785 A1 2/2018 Mitten et al.
2020/0214341 A1 * 7/2020 McKenzie ..... B65D 5/0085
2021/0171235 A1 * 6/2021 Boland ..... B65D 5/38
2021/0371172 A1 * 12/2021 Markarian ..... B65D 59/04

FOREIGN PATENT DOCUMENTS

DE 60222153 T2 6/2008
EP 2241516 A1 10/2010
JP 2003-128148 A 5/2003
TW 201318572 A 5/2013
WO 2015086298 A1 6/2015
WO 2015088744 A1 6/2015

OTHER PUBLICATIONS

Search Report dated Mar. 19, 24 from the Office Action for Chinese Application No. 201980093011.X Issued Mar. 22, 24, pp. 1-3.
Search Report dated Nov. 18, 2024 from the Office Action for Chinese Application No. 201980093011.X Issued Nov. 20, 2024, pp. 1-2.

* cited by examiner

40

SMOKING ARTICLES STORAGE BOX

CROSS-REFERENCE TO RELATED APPLICATIONS

The present application is a national phase entry under 35 U.S.C. § 371 of International Application No. PCT/EP2019/058196, filed Apr. 1, 2019, published in English, the disclosure of which is incorporated herein by reference.

1. TECHNICAL FIELD

The present invention relates to a smoking articles storage box. The smoking articles storage box is particularly suitable for storing an electronic cigarette and accessories thereof, like disposable cartridges, a charging cable, a liquid tank or a user manual.

2. PRIOR ART

Fragile goods, like smoking articles and particularly electronic cigarettes are usually packaged and brought into market in small boxes or containers in order to protect the goods during transport.

More expensive goods like electronic cigarettes are packaged in display boxes that on the one hand protect the electronic cigarette during transport by separating loose parts from each other in order to prevent friction and on the other hand provide an easy access for the user to remove the electronic cigarette and its accessories. However, some display boxes for electronic cigarettes have the disadvantage that the electronic cigarette cannot be take out easily or conveniently from the display box. This is because for the transport function it is required that the electronic cigarette is tightly held within the box for protection thereof.

Thus, there is the problem to provide a smoking articles storage box that on the one hand provides a good protection of the smoking article and on the other hand allow the user to conveniently take the smoking article out of the box.

3. SUMMARY OF THE INVENTION

The above-mentioned problem is solved by a smoking articles storage box according to claim 1.

The above mentioned problem is particularly solved by a smoking articles storage box, comprising an outer container having a base portion and a lid portion; a first storage layer element, arranged within the base portion at a lower level; at least one higher-level element, removably arranged within the base portion at a higher-level; wherein the first storage layer element comprises a first contact edge at one side and a second contact edge at the opposite side thereof, and wherein the first and second contact edges form support elements for the at least one higher-level element within the storage box.

The provision of contact edges of the first storage layer element at opposing sides of the first storage layer element enables that the two layers within the box are in contact with each other without generating any friction or contact in the center area between the two layers. This prevents damaging of the smoking articles or accessories held in the first storage layer element. Particularly, there is no need for an additional spacer that holds the at least one higher-level element at this higher lever within the box. Thus, the first storage layer element integrates the functions of holding a product and holding a higher-level element above the first storage layer element and above the product. In this way a very cost and manufacturing efficient two or more layered smoking articles storage box is provided. Preferably, the contact edges form the exclusive vertical support for the higher-level element within the box and are thus the highest areas of the first storage layer element within the storage box.

Additionally, since the contact edges for supporting the higher-level element are arranged at opposite sides of the first storage layer element there is the possibility to design the space in-between these contact edges freely, particularly such that the smoking article or accessory can be grasped and taken out easily by the user.

Preferably, the first storage layer element comprises an upper surface that has a concave shape. A concave shape of the upper surface enables the smoking article or accessory to protrude from the first storage layer element such that it can be easily grasped and removed from the first storage layer element. On the other hand, this concave shape enables that the contact edges for supporting the higher-level element are provided at opposing sides of the first storage layer element.

Preferably, the first storage layer element provides a space above the upper surface and between the first and second contact edges. This space can be partly occupied by the smoking article or accessory and further be used to provide a void for grasping the smoking article or accessory from the sides thereof.

Preferably, the higher-level element is a second storage layer element. Thus, the higher-level element can—like the first storage layer element—be used to hold and present to the user smoking article or accessory. The multi-level arrangement of the smoking articles storage box allows for an aesthetical pleasing and ergonomically optimized storage and presentation of the smoking article or accessories. For example, the second storage layer element can hold and present exclusively an electronic cigarette, which allows that the void around the electronic cigarette can be maximized for an easy removal of the electronic cigarette.

Preferably, the second storage layer element comprises a first contact edge at one side and a second contact edge at the opposite side thereof, wherein the first and second contact edges form support elements for the second storage layer element. Such opposing contact edges of the second storage layer element provide defined contact positions of the second storage layer element. This further prevents any friction or damage of the second storage layer element to the smoking article or accessory located below.

Preferably, the first and second contact edges are linear in shape and provide horizontal support elements. Such linear support elements of the first and second storage layer elements provide on the one hand a secure support for the second storage layer element on top of the first storage layer element within the box and on the other hand, leave maximum free space between the storage layers without the need for additional spacers for separating the storage layers.

Preferably, the first and second contact edges are located close to the inner surface of opposing side walls of the base portion. Thus the first and second storage layer elements are positioned within the base portion with only little or no play, which prevents undesired movements of the first and second storage layer element within the storage box.

Preferably the second storage layer element comprises an upper surface that has a convex shape and/or comprises a lower surface that has a concave shape. Such concave shape is also favorably providing a void for grasping the smoking article or accessory from the sides thereof.

Preferably, the second storage layer element comprises a grip hole for facilitating removing the second storage layer element out of the base portion. The grip hole allows the user to introduce at least one finger for easily grasping the second storage layer element for removing it out of the base portion of the storage box. Preferably, the grip hole is arranged under the smoking article or accessory held by second storage layer element such that it is only visible when the smoking article or accessory is removed from the second storage layer element. This improves appearance of the storage box containing the smoking article or accessory.

Preferably, each of the first and the second storage layer elements comprises at least one recess for holding an item. The recess positions and holds smoking articles or accessories at least partly in or on the first and the second storage layer elements. Preferably, the recess is shaped to be adapted to the contour or outer shape of the smoking article or accessory it holds. Thus, the smoking articles or accessories are placed and held in a defined position within the storage box.

Preferably, the first storage layer element and the second storage layer element have an essentially rectangular footprint, adapted to the inside of the base portion. Thus, the first and second storage layer elements cover essentially the complete inside, preferably the floor, of the base portion such that the elements below the respective layer element are hidden from view. Further, the first and second storage layer elements are essentially prevented from moving within the storage box, what prevents damaging the items held by the first and second storage layer elements.

Preferably, the smoking articles storage box further comprising a flat or cuboid intermediate layer element as further higher-level element. Preferably, the intermediate layer element is positioned between the first storage layer element and the second storage layer element. Preferably, the intermediate layer element comprises a hollow interior space which can be opened. Such space can be used to store further flat items, like accessories, user manuals, data carriers, etc.

Preferably, the intermediate layer element comprises at least one gripping tab, which is arranged to be below the grip hole of the second storage layer element. Thus, the gripping tab can protrude through the grip hole and can be grasped by the user for removing both, the intermediate layer element together with the second storage layer element.

Preferably, the lid is a slip lid. Preferably, the slip lid has a height that is the equal or larger than the height of the base portion. Thus, the smoking articles storage box in the closed condition appears like a rectangular cube.

Preferably, the lid is hinged to the base portion. In another embodiment the lid can also be a hinged lid, such that base portion and lid portion together preferably form an integral outer container.

4. SHORT DESCRIPTION OF THE DRAWINGS

Figure 2:
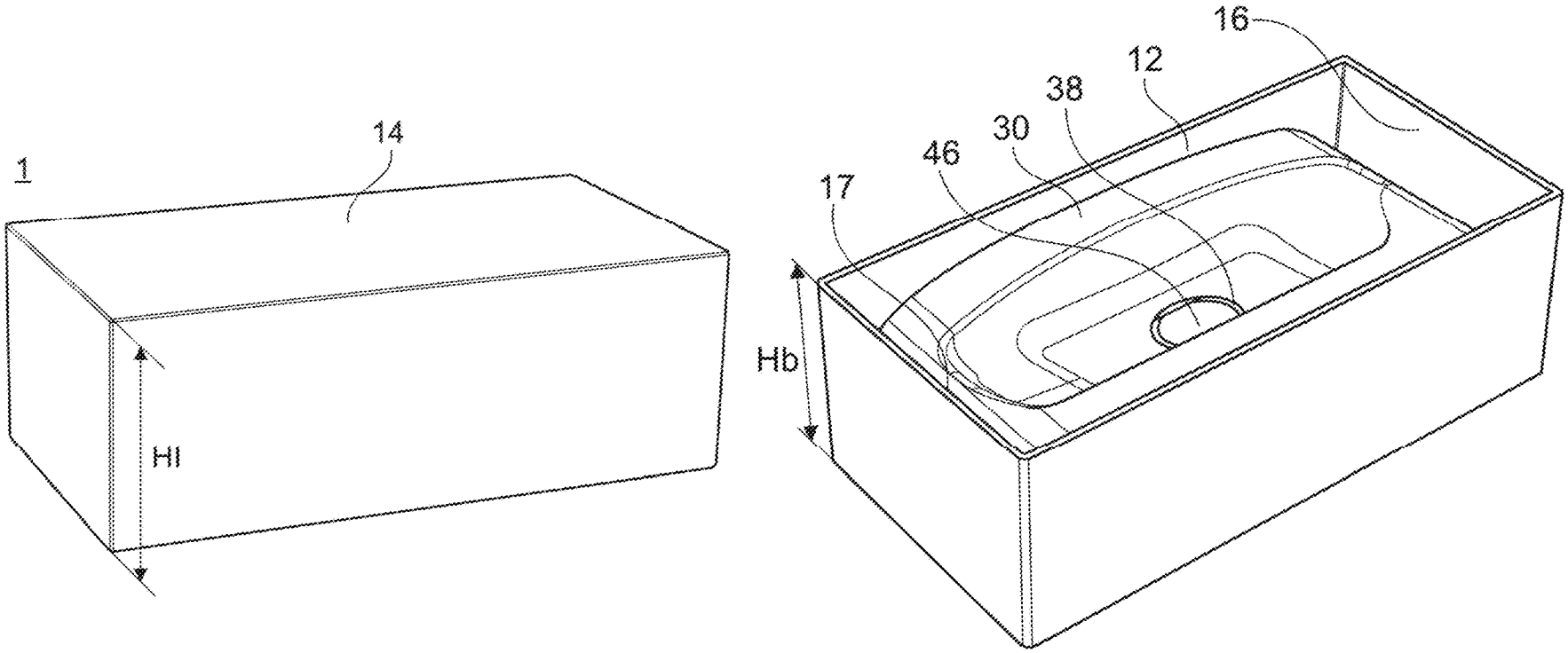
Figure 3B:
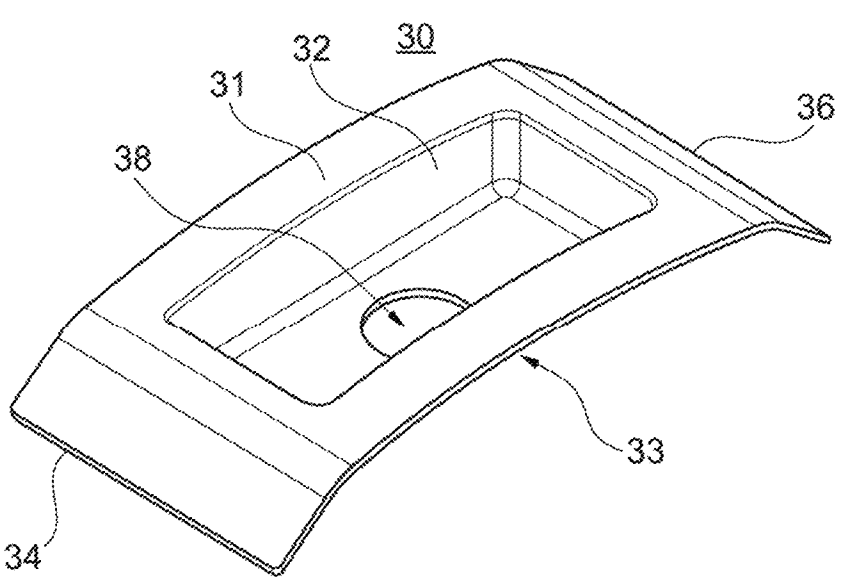
Figure 3A:
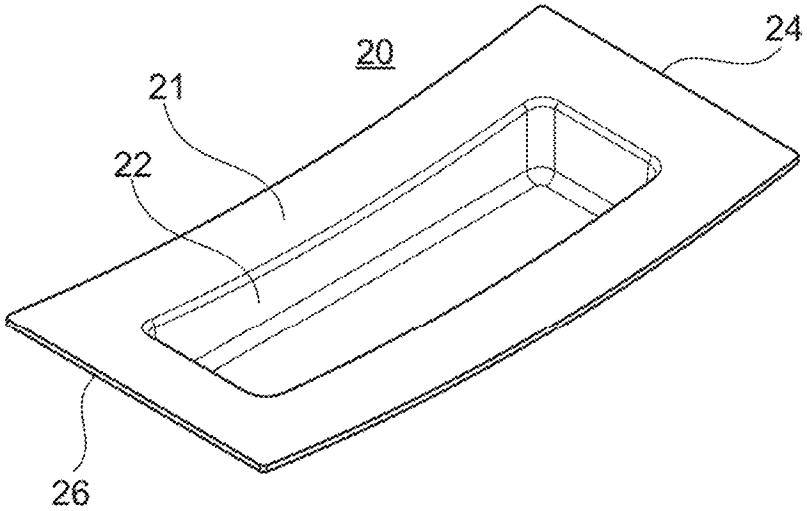
Figure 4C:
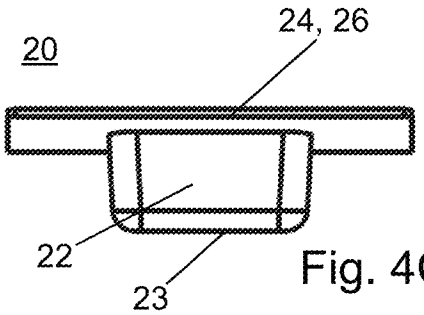
Figure 4B:
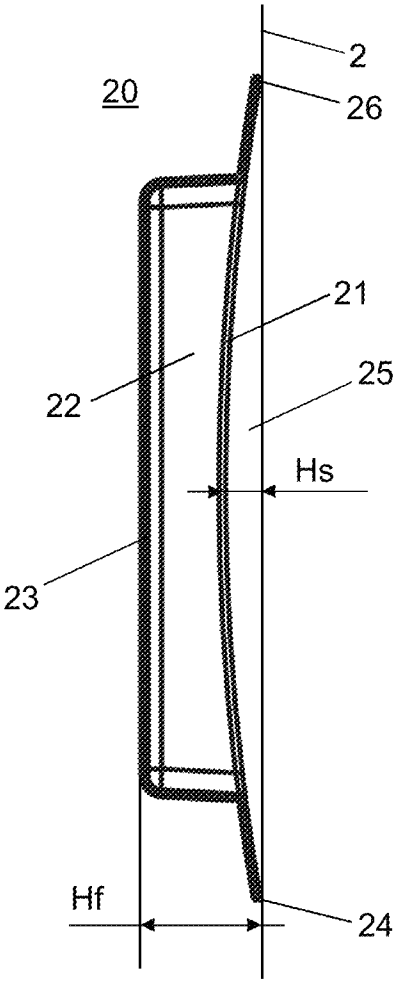
Figure 4A:
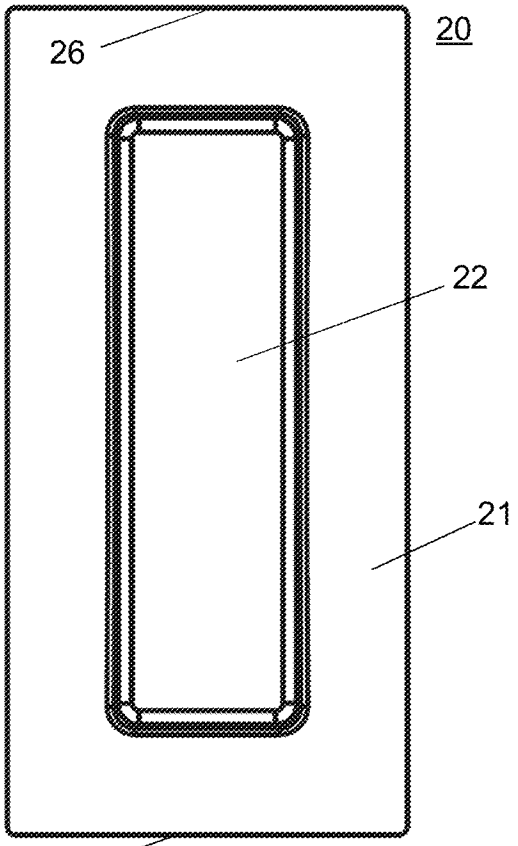
Figure 5C:
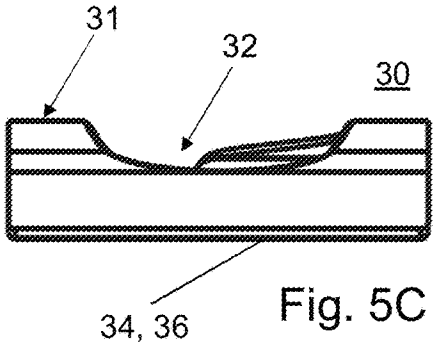
Figure 5D:
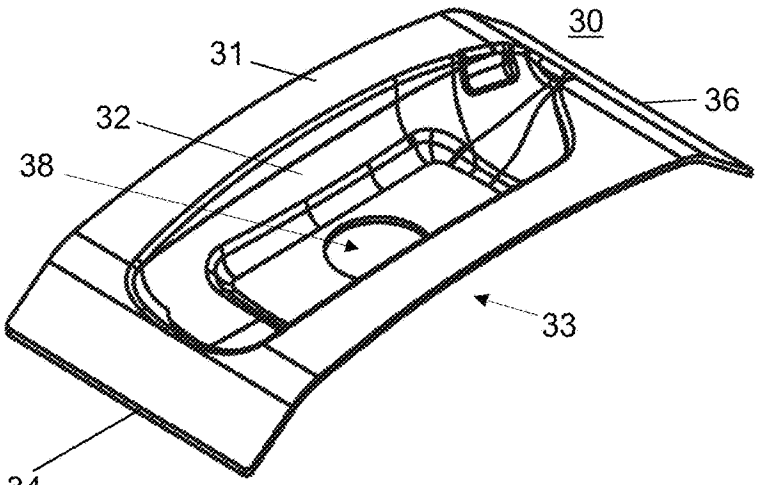
Figure 5B:
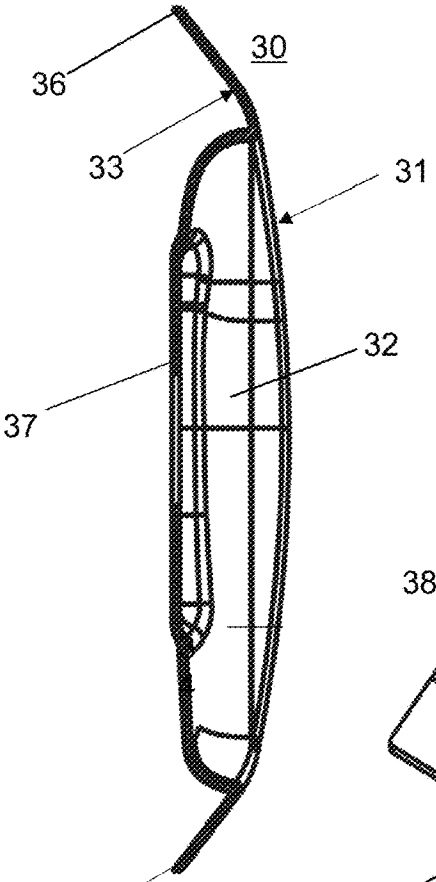
Figure 5A:
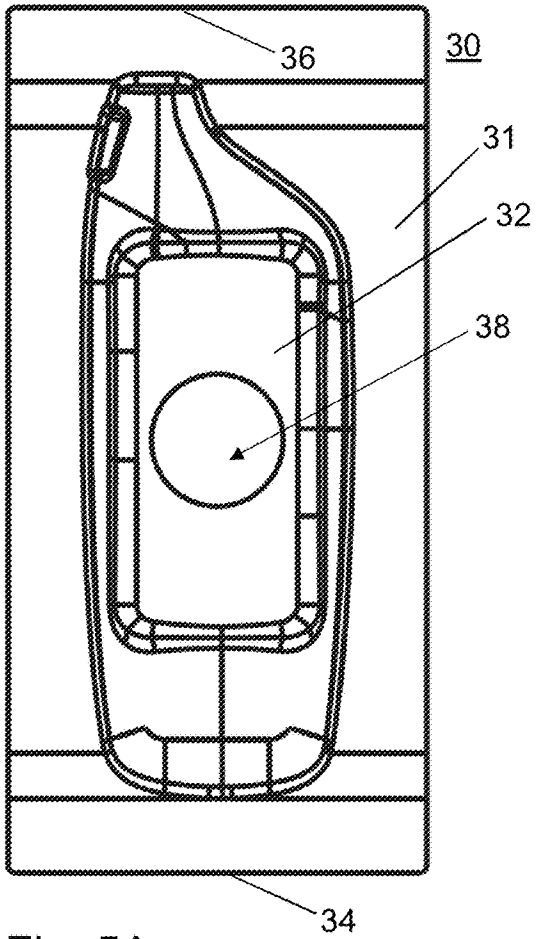
Figure 6:
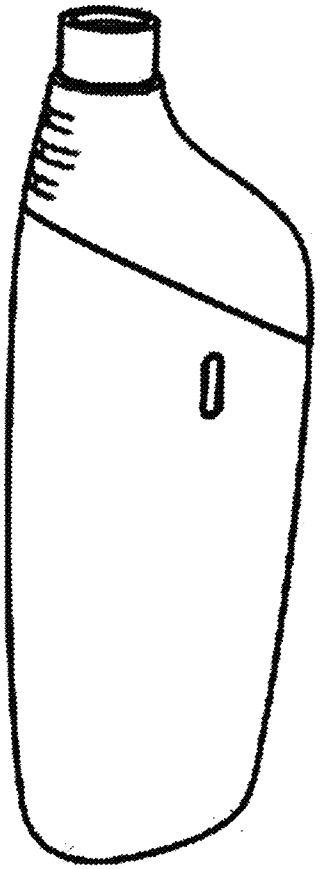
Figure 7:
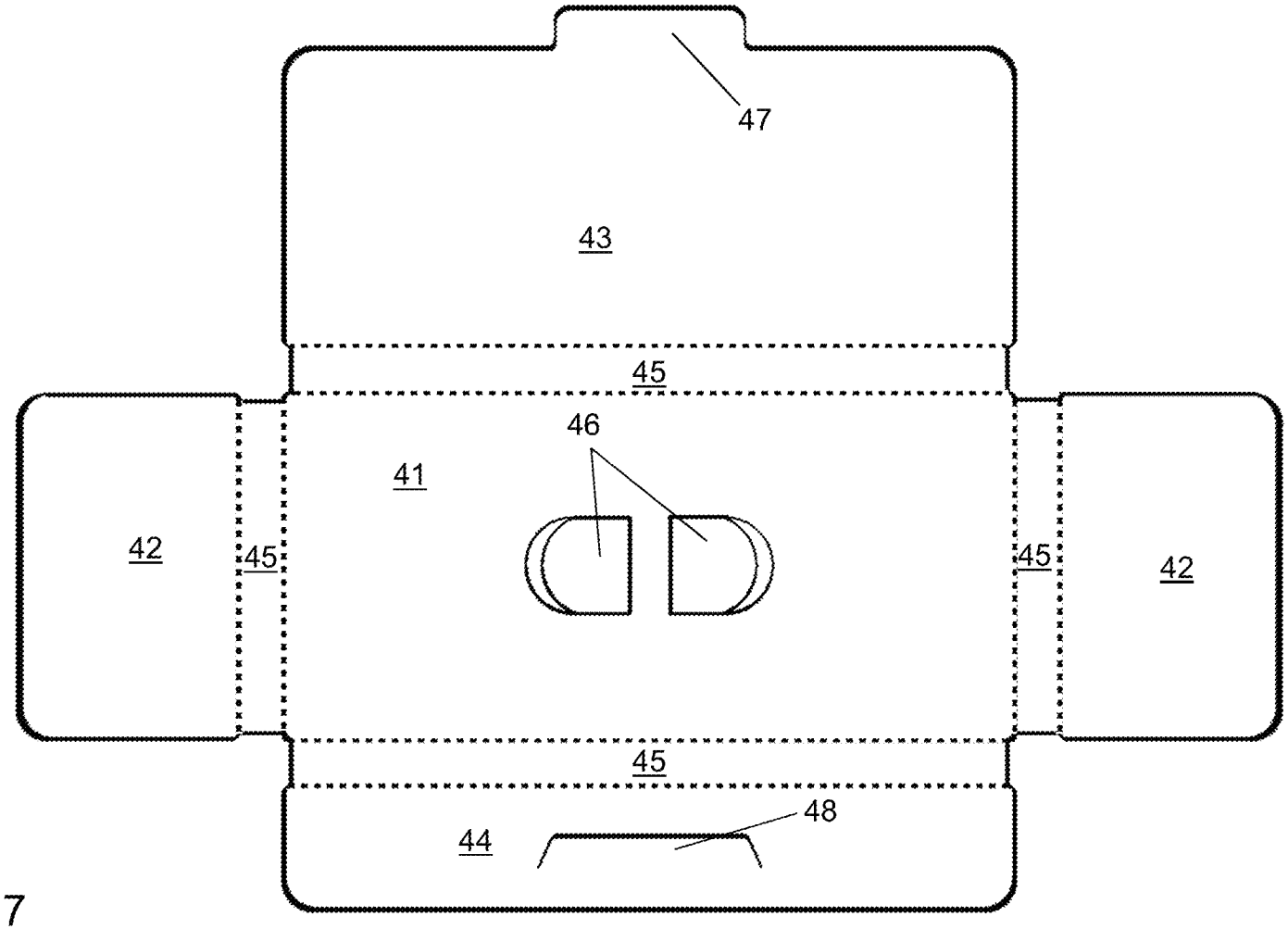
Figure 8:
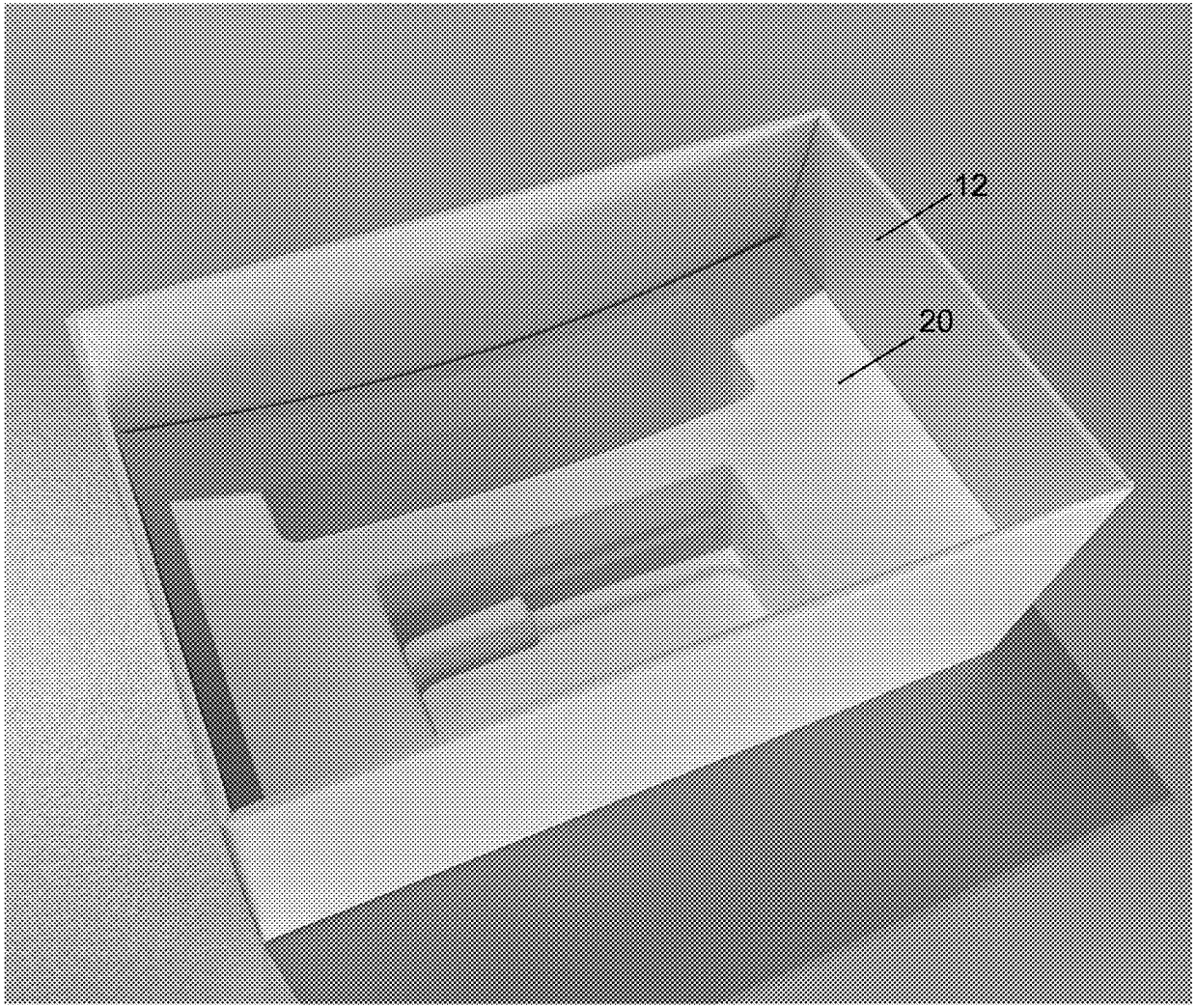
Figure 9:
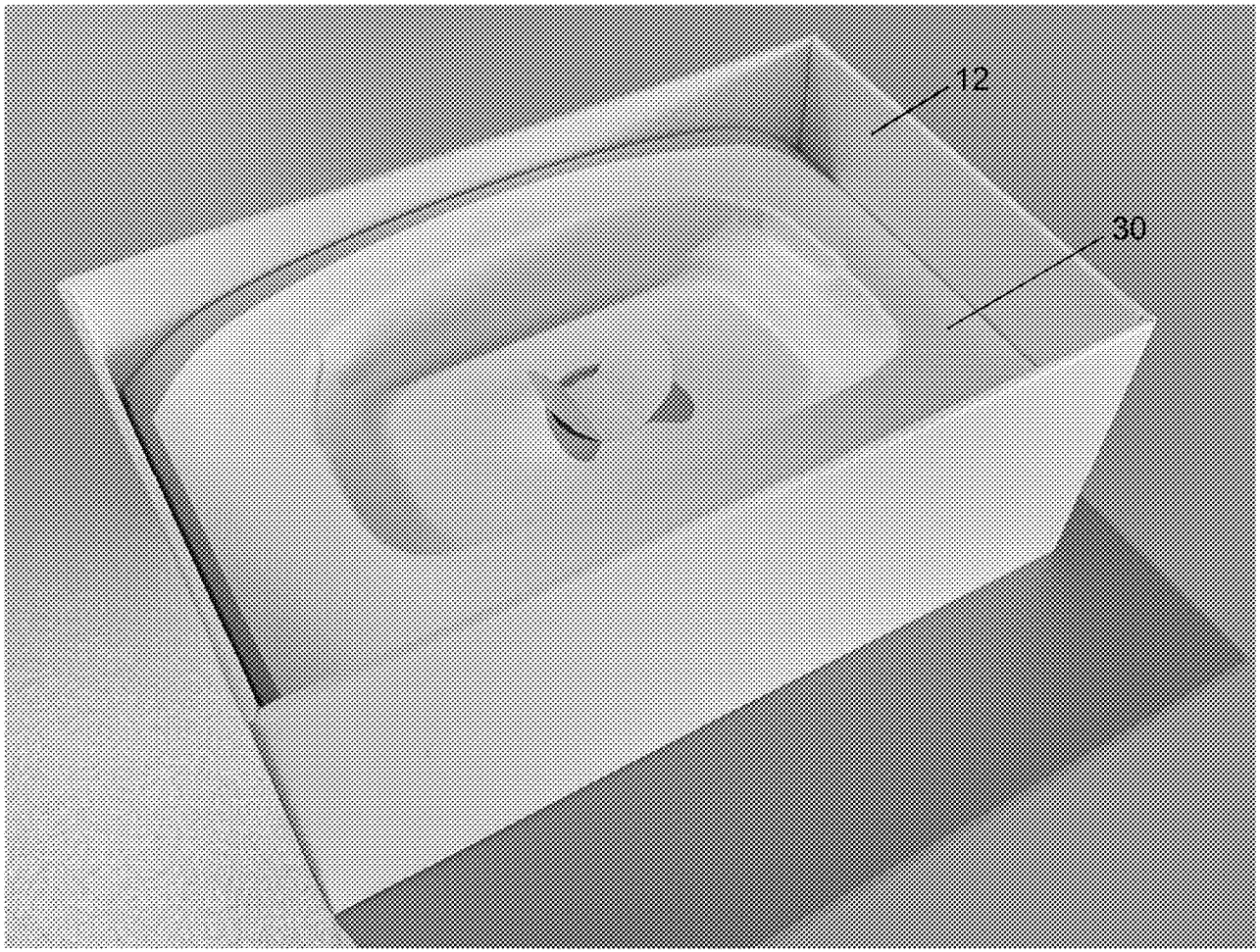

In the following, preferred embodiments of the invention are disclosed by reference to the accompanying figures, in which shows:

FIG. 1: a cross-sectional side view of a preferred embodiment of a smoking articles storage box;

FIG. 2: a schematic perspective view of the smoking articles storage box of FIG. 1;

FIG. 3*a*: a schematic perspective view of a preferred embodiment of a first storage layer element;

FIG. 3*b*: a schematic perspective view of a preferred embodiment of a second storage layer element;

FIGS. 4A-C: a top view, a side view and a frontal view of the first storage layer element of FIG. 3;

FIGS. 5A-D: a top view, a side view, a frontal view and a schematic perspective view of a preferred embodiment of the second storage layer element;

FIG. 6 a schematic front view of a smoking article;

FIG. 7: a top view of a blank for an embodiment of an intermediate layer element;

FIG. 8 a schematic perspective view of a further embodiment of the smoking articles storage box showing the base portion and the first storage layer;

FIG. 9 a schematic perspective view of a further embodiment of the smoking articles storage box showing the base portion and the second storage layer; and.

Figure 10:
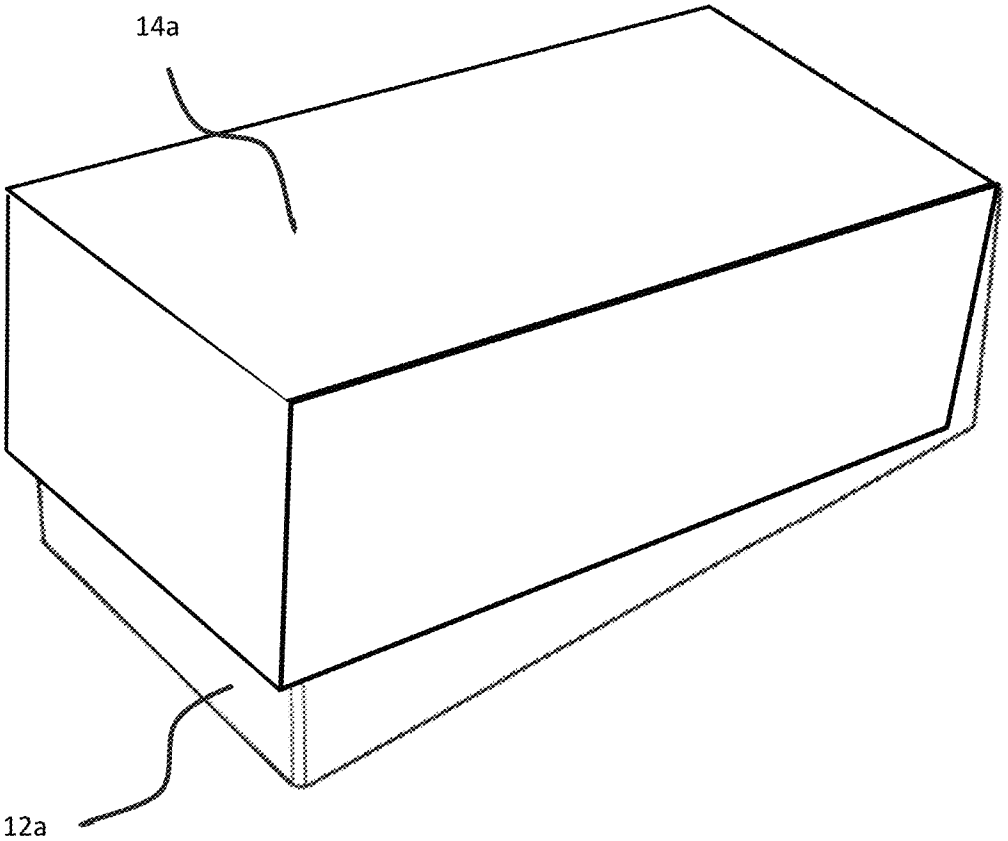

FIG. 10 a schematic perspective view of a further embodiment of the smoking articles storage box showing the lid hinged to the base portion.

5. DESCRIPTION OF PREFERRED EMBODIMENTS

In the following preferred embodiments of the invention are described with respect to the figures.

FIGS. 1 and 2 show an embodiment of a smoking articles storage box 1. The storage box 1 of this embodiment comprises an outer container 10, a first storage layer element 20, arranged within the outer container 10 at the lowest level, an intermediate layer element 40, arranged within the outer container 10 at a higher level, preferably directly above the first storage layer element 20, and a second storage layer element 30, arranged within the outer container 10 at the highest level, preferably directly above the intermediate layer element 40. Thus, the storage box 1 preferably provides at different heights within the storage box 1 three different levels for storing smoking articles 5 (see FIG. 6) or accessories.

In another embodiment (not shown) second storage layer element 30, can be arranged directly above the first storage layer element 40. In such embodiment the intermediate layer element 40 can be left out or can be arranged at the highest level within the outer container 10, preferably directly above the second storage layer element 30. In this embodiment the storage box 1 provides two different levels for storing smoking articles 5 or accessories.

The outer container 10 comprises a base portion 12 and a lid portion 14. The lid portion can be a slip lid 14 or a hinged lid (as shown in FIG. 10, where lid portion 14*a* is hinged to base portion 12*a*). The base portion 12 and the lid portion 14 preferably have a rectangular cubic shape and are preferably made of a stiff cardboard material. The outer container may have a length of 10-15 cm, a height Hl of 3-6 cm high and a width of 5-8 cm. With such a size the smoking articles storage box 1 can hold an electronic cigarette together with all accessories and user manuals.

The height Hl of the lid portion 14 is preferably equal or slightly larger than the height Hb of the base portion 12. Thus, the base portion 12 completely fits into the lid portion 14.

FIGS. 3 and 4 shows an embodiment of the first storage layer element 20 in different views. The first storage layer element 20 comprises a recess or a cavity 22 for holding an item, preferably a smoking article 5 or accessory. The first storage layer element 20 preferably consists of a layer of material that has a curved shape. The layer of material of the first storage layer element 20 preferably has a thickness of about 0.1 to 3.0 mm, depending on the material used. The first storage layer element 20 can be made by deep-drawing of a layer of plastic material, could be injection molded or could be 3D-printed. Alternatively, and the first storage layer element 20 could be made out of a curved paper fiber material (e.g. molded or bent paper material).

The first storage layer element 20 comprises a first contact edge 24 at one side and a second contact edge 26 at the opposite side of the first storage layer element 20. These preferably, linearly shaped and horizontally arranged contact edges 24, 26 form support elements for the at least one higher level elements 30 and 40. The contact edges 24, 26 are further located close to or abutting the inner surface of opposing side walls 16, 17 of the base portion 12, for preventing an undesired movement of the first storage layer element 20. The first storage layer element 20 preferably has a rectangular footprint as shown in FIG. 4A which fits into the base portion 12. Thus, the inside bottom of the base portion 12 is not visible to the user.

The first storage layer element 20 further comprises an upper surface 21 that has a concave shape. The upper surface 21 preferably surrounds the recess 22 and forms a visible surface. The concave shape of the upper surface 21 on the one hand facilitates removal of the items held by the recess 22 and on the other hand positions the contact edges 24, 26 as highest level elements of the first storage layer element 20. Thus, as shown in the side view of FIG. 4B, the first storage layer element 20 provides a space 25 above the concave upper surface 21 and between the first and second contact edges 24, 26, as indicated by means of the auxiliary line 2 between the contact edges 24, 26. The height Hs of the space 25 depends upon the curvature of the concave upper surface 21 and measures about 4-10 mm. Preferably, the height Hs of the space 25 measures about 30%-50% of the total height Hf of the first storage layer element 20. This has the advantage that enough space 25 is provided for the user to get a grip to the smoking article 5 or accessory and at the same time torsional stability of the first storage layer element 20 is achieved as the side thereof have a sufficient height.

The first storage layer element 20 has a bottom contact surface 23 in contact with the inner bottom of the base portion 12. Hence, first storage layer element 20 can be removably positioned inside the storage box 1. The first storage layer element 20 may be fixedly attached (by e.g. an adhesive or a mechanical connection element) to the inner bottom of the base portion 12 such that it cannot be removed from the base portion 12. In other embodiments the first storage layer element 20 is not glued to the base portion 12 and FIGS. 5A-D show an embodiment of the second storage layer element 30 in different views. The second storage layer element 30 forms a higher-level element as it is arranged at a higher level than the first storage layer element 20 within the storage box 1. The second storage layer element 30 preferably comprises a recess 32 for holding an item, preferably a smoking article 5 or accessory. Like the first storage layer element 20, the second storage layer element 30 preferably consists of a layer of material that is three-dimensionally shaped. The layer of material of the second storage layer element 30 preferably has a thickness of about 0.1 to 3.0 mm, depending on the material used. The second storage layer element 30 can be made by deep-drawing of a layer of plastic material, could be injection molded or could be 3D-printed. Alternatively, the second storage layer element 30 could be made out of paper fiber material (e.g. molded or bent paper material).

The first storage layer element 30 comprises a first contact edge 34 at one side and a second contact edge 36 at the opposite side of the second storage layer element 30. These preferably, linearly shaped and horizontally arranged contact edges 34, 36 support the second storage layer element 30. Thereby, the contact edges 34, 36 of the second storage layer element 30 can directly rest upon the contact edges 24, 26 of the first storage layer element 20 (not shown) or can rest upon the intermediate layer element 40, as in the embodiment of FIG. 1. The contact edges 34, 36 are further located close to or abutting the inner surface of opposing side walls 16, 17 of the base portion 12 for proving an undesired movement of the second storage layer element 30.

The second storage layer element 30 preferably has a rectangular footprint as shown in FIG. 6A which fits into the base portion 12. Thus, the elements below the second storage layer element 30 are essentially covered and not visible to the user.

The second storage layer element 30 further comprises an upper surface 31 that has a curved or a convex shape. The upper surface 31 preferably surrounds the recess 32 and forms a visible surface. The concave shape of the upper surface 31 on the one hand facilitates removal of the items held by the recess 32 and on the other hand positions the contact edges 34, 36 as lowest level elements of the second storage layer element 30. Thus, as shown in the sectional view of FIG. 1, the second storage layer element 30 securely rests upon the underlying element 40 or 20 by the contact edges 34, 36.

As shown in FIG. 1, the underside of recess 32 may be arranged at the same level as the contact edges 34, 36. Thus, the second storage layer element 30 may additionally rest upon an intermediate layer element 40, which preferably has a flat upper surface 41 (see FIG. 7) at least by the contact edges 34, 36, but also by an underside 37 of the recess 32. In another embodiment (not shown), the underside of recess 32 may be arranged at a higher level as the contact edges 34, 36, such that the second storage layer element 30 only rests upon the contact edges 34, 36.

Further, the second storage layer element 30 further comprises a lower surface 33 that has a concave shape. The concave shape of the lower surface provides a space 35 (see FIG. 1) underneath than can be generally used for items located on the first storage layer element 20. This has the advantage that a larger space is created in between the first storage layer 20 and the second storage layer 30, which is particularly advantageous in the absence of the intermediate layer 40.

The second storage layer element 30 is removably connected to the outer container 10. Thus, the second storage layer element 30 can be fully removed out of the storage box 1 for providing access to the elements below the second storage layer element 30. For facilitating removing the second storage layer element 30 it may comprise a grip hole 38. The grip hole 38 is preferably arranged in the bottom wall of the recess 32 such that is not visible when a smoking article or an accessory is arranged within the recess 32. Hence, the grip hole 38 preferably has minor dimension smaller than the smoking article 5 (e.g. electronic cigarette 5) or the accessory placed in the recess 32. Preferably the grip hole has a diameter of about 15 mm, suitable for receiving a finger of a user. The grip hole 38 can also be dimensioned and located to allow access to underlying gripping tabs 46 of the intermediate storage layer element 40 (see FIG. 7).

FIG. 6 shows an electronic cigarette 5 as an embodiment of a smoking article 5. The electronic cigarette 5 may be stored by the second storage layer element 30. In the embodiment of FIG. 5A-D the recess or cavity 32 is adapted to the outer shape of the smoking article 5. Thus, the smoking article 5 is held with only little play by the second storage layer element 30.

FIG. 7 shows a blank of an intermediate layer element 40. The intermediate layer element 40 can be a further higher-level element and is preferably arranged between the first storage layer element 20 and the second storage layer element 30. However the intermediate layer element 40 can also be arranged above the second storage layer element 30.

The intermediate layer element 40 has a shape corresponding to the inner shape of the base portion 12 of the storage box 1. Generally this corresponds to a rectangular flat and hollow cube, which provides an openable space inside. Such space can be used to store further flat items, like accessories, user manuals, data carriers, etc. As shown in FIG. 7 the intermediate layer element 40 may be formed by folding of a flat cardboard blank along folding lines, shown in dashed lines. The intermediate layer element 40 comprises a top wall 41, side walls 45 and bottom walls 42, 43 and 44. The bottom walls 42, 43 and 44 of the intermediate layer element 40 are preferably only folded from the blank but not glued together. Therefore, the intermediate layer element 40 can be fully opened by the bottom walls 42, 43 and 44 for providing access to the item inside. The bottom wall 48 comprises a cutout 48 and bottom wall 43 comprises a tab 47, which can be inserted into the cutout 48 for holding the intermediate layer element 40 together in the folded and closed cubic state.

Preferably, the intermediate layer element 40 further comprises at least one gripping tab 46. In the embodiment of FIG. 7 the intermediate layer element 40 comprises two gripping tabs 46. The gripping tabs 46 are preferably folded to the top such that they protrude from the upper surface of the top wall 41 and can be grasped by a user.

Preferably, the gripping tabs 46 are cut out from the top wall 41 to be arranged below the grip hole 38 of the second storage layer element 30. Thus, the gripping tabs 46 can protrude through the grip hole 38 and can be grasped by the user for easily removing both, the intermediate layer element 40 together with the second storage layer element 30 resting thereon.

Thus, the smoking articles storage 1 box provides a good support and protection for the smoking articles and accessories held therein during shipping and further provides a high-quality unboxing experience for the user and an ergonomically optimized and convenient access to the smoking articles and accessories. Further, due to the two or multi-layer design the overall space consumption of the smoking articles storage box 1 is minimized. Optionally, the intermediate layer element 40 can be a booklet, such as a user manual. The user manual can be provided with a gripping tab 46 or a grip hole similar to grip hole 38.

FIG. 8 shows a further embodiment of the smoking articles storage box 1 having a base portion 12, similar to the base portion 12 of the previous embodiments, and a first storage layer element 20. The first storage layer element 20 is similar to the first storage layer element 20 of the previous embodiments but comprises two recesses or cavities 22 for holding smoking articles 5 or accessories.

FIG. 9 shows a further embodiment of the smoking articles storage box 1 having a base portion 12, similar to the base portion 12 of the previous embodiments, and a second storage layer 30. The second storage layer element 30 is similar to the second storage layer element 30 of the previous embodiments but comprises a recess or cavity 32 for holding a differently shaped smoking article 5.

LIST OF REFERENCE SIGNS

1 smoking articles storage box
5 smoking article/electronic cigarette
2 auxiliary line
10 outer container
12 base portion
14 lid portion
16 side wall
17 side wall
20 first storage layer element
21 upper surface
22 recess/cavity
23 bottom contact surface
24 first contact edge
25 space
26 second contact edge
30 second storage layer element
31 upper surface
32 recess/cavity
33 lower surface
34 first contact edge
35 space
36 second contact edge
37 underside of recess
38 grip hole
40 intermediate layer element
41 top wall
45 side walls
42, 43, 44 bottom walls
46 gripping tabs
47 tab
48 cutout

The invention claimed is:

1. A smoking articles storage box, comprising:

a. an outer container having a base portion and a lid portion;

b. a first storage layer element, arranged within the base portion at a lower level; and c. at least one higher-level element, removably arranged within the base portion at a higher level, wherein the first storage layer element comprises a first contact edge at one side and a second contact edge at an opposite side thereof, wherein the first and second contact edges form support elements for the at least one higher-level element within the storage box, wherein the first and second contact edges form an exclusive vertical support for the at least one higher-level element, wherein the first and second contact edges are located adjacent to inner surfaces of opposing side walls of the base portion, respectively, wherein the first and second contact edges only extend along and parallel to the inner surfaces of the opposing side walls, and wherein one of the at least one higher-level element is a second storage layer element.

2. The smoking articles storage box according to claim 1, wherein the first storage layer element further comprises an upper surface that has a concave shape.

3. The smoking articles storage box according to claim 2, wherein the first storage layer element provides a space above the upper surface and between the first and second contact edges.

4. The smoking articles storage box according to claim 1, wherein the second storage layer element comprises a first contact edge at one side and a second contact edge at an opposite side thereof, wherein the first and second contact edges of the second storage layer element form support elements for the second storage layer element.

5. The smoking articles storage box according to claim 1, wherein the first and second contact edges of the first storage layer element and the first and second contact edges of the second storage layer element are linear in shape and provide horizontal support elements.

6. The smoking articles storage box according to claim 1, wherein the second storage layer element comprises an upper surface that has a convex shape and/or comprises a lower surface that has a concave shape.

7. The smoking articles storage box according to claim 1, wherein the second storage layer element comprises a grip hole for facilitating removing the second storage layer element out of the base portion.

8. The smoking articles storage box according to claim 1, wherein each of the first and the second storage layer elements comprises at least one recess for holding an item.

9. The smoking articles storage box according to claim 1, wherein the first storage layer element and the second storage layer element each has a substantially rectangular footprint, adapted to an inside of the base portion.

10. The smoking articles storage box according to claim 1, wherein one of the at least one higher-level element is a flat or cuboid intermediate layer element.

11. The smoking articles storage box according to claim 10, wherein the intermediate layer element is positioned between the first storage layer element and the second storage layer element.

12. The smoking articles storage box according to claim 10, wherein the intermediate layer element comprises a hollow interior space which can be opened.

13. The smoking articles storage box according to claim 1, wherein the lid portion is a slip lid.

14. The smoking articles storage box according to claim 13, wherein the slip lid has a height that is equal to or larger than a height of the base portion.

15. The smoking articles storage box according to claim 1, wherein the lid portion is hinged to the base portion.

* * * * *